US009903377B2

(12) United States Patent
He et al.

(10) Patent No.: US 9,903,377 B2
(45) Date of Patent: Feb. 27, 2018

(54) VENTILATING DEVICE

(71) Applicants: Panasonic Ecology Systems Guangdong Co., Ltd., Foshan, Guangdong (CN); Panasonic Corporation, Osaka (JP)

(72) Inventors: Yanbiao He, Gaungdong (CN); Guancheng Hou, Guangdong (CN); Shouyong Gao, Guangdong (CN); Bodong Zhong, Guangdong (CN); Fengwei Yan, Guangdong (CN); Daisuke Tsubosa, Aichi (JP)

(73) Assignees: PANASONIC ECOLOGY SYSTEMS GUANGDONG CO., LTD., Foshan, Guangdong (CN); PANASONIC CORPORATION, Osaka (JP)

( * ) Notice: Subject to any disclaimer, the term of this patent is extended or adjusted under 35 U.S.C. 154(b) by 666 days.

(21) Appl. No.: 14/310,432

(22) Filed: Jun. 20, 2014

(65) Prior Publication Data

US 2015/0003980 A1 Jan. 1, 2015

(30) Foreign Application Priority Data

Jun. 27, 2013 (CN) ..... 2013 2 0384615 U

(51) Int. Cl.

| | |
|---|---|
| ***F04D 29/62*** | (2006.01) |
| ***F04D 25/06*** | (2006.01) |
| ***F24F 7/007*** | (2006.01) |
| *F24F 13/20* | (2006.01) |

(52) U.S. Cl.

CPC ..... *F04D 25/0693* (2013.01); *F04D 29/626* (2013.01); *F24F 7/007* (2013.01); *F24F 2013/205* (2013.01)

(58) Field of Classification Search

CPC ..... F04D 25/0693; F04D 29/626; Y10T 29/49876; F24F 7/007; F24F 2013/205

See application file for complete search history.

(56) References Cited

U.S. PATENT DOCUMENTS

| | | | | |
|---|---|---|---|---|
| 4,393,561 | A * | 7/1983 | Yuda | B60K 11/08 24/297 |
| 6,585,486 | B2 * | 7/2003 | Birdsell | H02G 3/086 415/213.1 |
| 9,416,989 | B1 * | 8/2016 | Tom | F24F 13/078 |
| 2009/0042428 | A1 * | 2/2009 | Henriott | A47B 21/06 439/215 |

FOREIGN PATENT DOCUMENTS

| | | |
|---|---|---|
| JP | 6-300341 | 10/1994 |

* cited by examiner

*Primary Examiner* — Logan Kraft
*Assistant Examiner* — Danielle M Christensen
(74) *Attorney, Agent, or Firm* — RatnerPrestia

(57) ABSTRACT

A ventilating device includes a rectangular frame, a louver, an adapter, a helix shell and a circuit board box. A mounting base at a bottom surface of the helix shell is configured for installation of a plurality of functional units thereon. The mounting base is provided with a base circuit board for interfacing with the functional units, and the circuit board box is coupled to the mounting base by a lead wire. Both the circuit board box and the mounting base include a hole, through which the lead wire passes. These holes are arranged in a linear manner in an up-down direction arranged at the side towards an air outlet. The plurality of functional units are configured to be freely assembled or disassembled individually to or from the mounting base.

3 Claims, 8 Drawing Sheets

VENTILATING DEVICE

CROSS-REFERENCE TO RELATED APPLICATIONS

This application claims the benefit of Chinese patent application No. 201320384615.X, filed on Jun. 27, 2013 with State Intellectual Property Office of China, and the inventions of which are incorporated herein in its entirety by reference.

BACKGROUND OF THE INVENTION

Field of the Invention

The present invention relates to a ventilating device.

Description of the Related Art

A ventilating device existing in prior art has a structure as following: it comprises a body shell having an indoor air intake inlet provided at an bottom thereof and an indoor air discharging outlet provided at side faces or a top thereof, a blower disposed in the body shell and a louver mounted on the air intake inlet of the body shell, the louver being provided with a human body sensor (such as, seen from Japanese patent publication No. JP6-300341).

The existing ventilating device, due to the mounted human body sensor therein, may not perform additions and alternations in terms of functions after having been sold. If the user tends to add or change the function of the used ventilating device, he has to buy another one with the function he wants to add or change.

Further, if various functional units are mounted on the ventilating device, a lead wire coupled between each functional unit and a circuit board for driving a motor would be provided in longer length in order to keep away from the air inlet, thereby increasing the cost.

SUMMARY OF THE INVENTION

The present invention has been made to overcome or alleviate at least one aspect of the above mentioned disadvantages existing in the conventional technical solutions.

Accordingly, it is an object of the present invention to provide a ventilating device, which achieves additions and/or alterations of function(s) as required.

In order to achieve the above objects, a ventilating device is provided as follows. The ventilating device comprises: a rectangular frame provided with an opening at a bottom thereof, a louver covering the bottom of the frame, an adapter communicating with outdoor at one side of the frame, a helix shell configured to house fan blades and a motor therein, and a circuit board box. The helix shell is provided with an air inlet for communicating with indoor and an air outlet for communicating with the adapter, and the circuit board box has a main circuit board for driving the motor therein. A mounting base for installation of a plurality of functional units thereon is disposed at lower side of the helix shell, wherein the mounting base is provided with a base circuit board for collecting a signal from the functional units, the circuit board box is coupled to the mounting base by a lead wire, and, the mounting base is located at a bottom surface of the helix shell, and wherein, a hole, through which the lead wire passes, in the circuit board box and a hole, through which the lead wire passes, in the mounting base are arranged in a linear manner in an up-down direction at the side towards the air outlet, and the plurality of functional units are configured to be freely assembled or disassembled individually to or from the mounting base.

The circuit board box is disposed on a top surface of the helix shell close to the air outlet, and horizontally placed between the top surface of the frame and the top surface of the helix shell.

The circuit board box is disposed on the side of the frame facing the air outlet of the helix shell, and vertically placed in a gap between the side of the frame provided with an adapter and the helix shell and close to the air outlet.

The functional units are respectively mounted in the functional unit boxes, and, on an outer wall of each of opposite sides of any of sets functional unit boxes, there is an integrally formed projection sheet, of which a first snap-fit sheet is configured to continue from the projection sheet at a lower side thereof and project in a direction opposite to the projection sheet, and a second snap-fit sheet is configured to continue from the projection sheet at an upper side thereof and project in a direction opposite to the projection sheet, wherein, at the upper end of the second snap-fit sheet of the projection sheet, a hook portion is provided to protrude towards the functional unit box, a pair of downwardly protruding fixing portions is provided with on the bottom surface of the mounting base, and, each fixing sheet is formed with a snap-fit hole to be snap-fitted by the hook portion.

The functional unit box is provided with guide ribs at both sides above the second snap-fit sheet, and each of the guide ribs includes a sloped portion widening outwardly in an upward direction and a vertical portion arranged along an end side of the fixing sheet in a downward direction.

The hook portion is formed with a slope guide portion at its upper side, sloping towards the outer wall from up to down, and a connection portion at its lower side, extending towards the snap-fitted hole and configured to be parallel to the top face of the helix shell.

The present invention has advantages of convenient additions and/or alterations of function(s) for the ventilating device as required, convenient wiring and low cost.

BRIEF DESCRIPTION OF THE DRAWINGS

These and/or other aspects and advantages of the present invention will become apparent and more readily appreciated from the following description of the embodiments, taken in conjunction with the accompanying drawings of which.

Figure 1A:
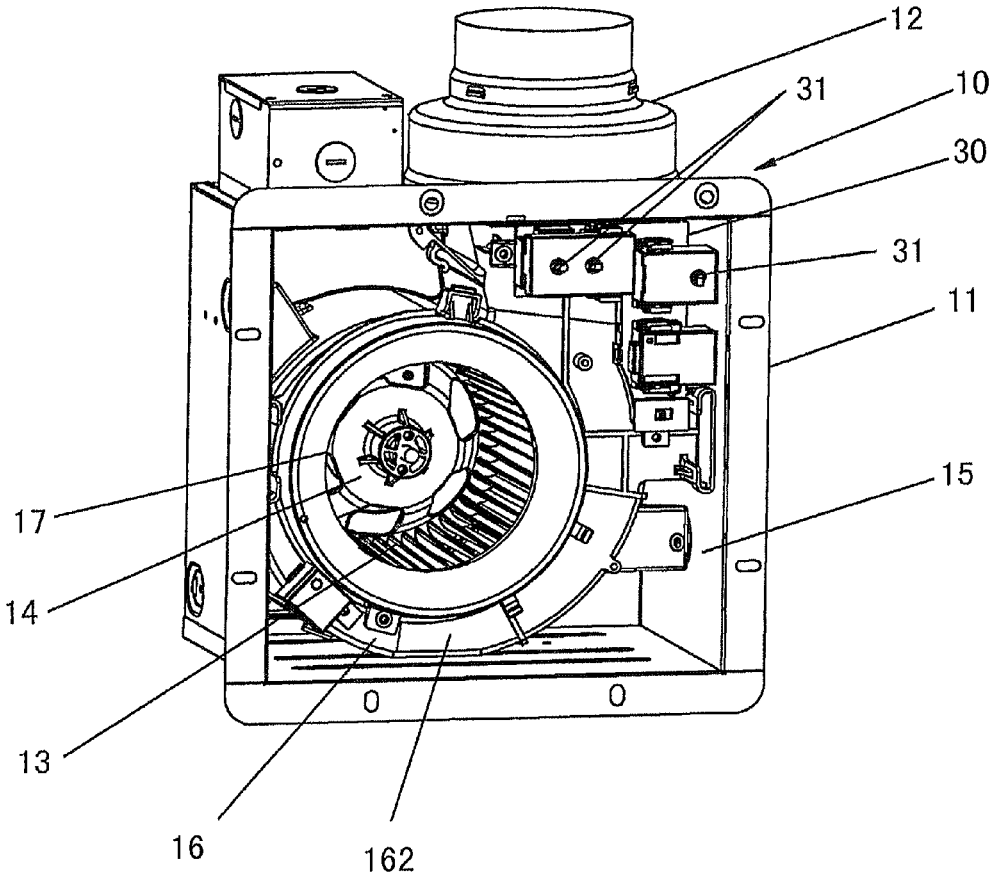
FIG. 1A is a schematic view of a ventilating device according to the first embodiment of the present invention.

The scope of the present invention will in no way be limited to the simply schematic views of the drawings, the number of constituting components, the materials thereof, the shapes thereof, the relative arrangement thereof, etc., and are disclosed simply as an example of an embodiment.

DETAILED DESCRIPTION OF THE PREFERRED EMBODIMENT

Exemplary embodiments of the present invention will be described hereinafter in detail with reference to the attached drawings, wherein the like reference numerals refer to the like elements. The present invention may, however, be embodied in many different forms and should not be construed as being limited to the embodiment set forth herein; rather, these embodiments are provided so that the present invention will be thorough and complete, and will fully convey the concept of the invention to those skilled in the art.

Figure 1B:
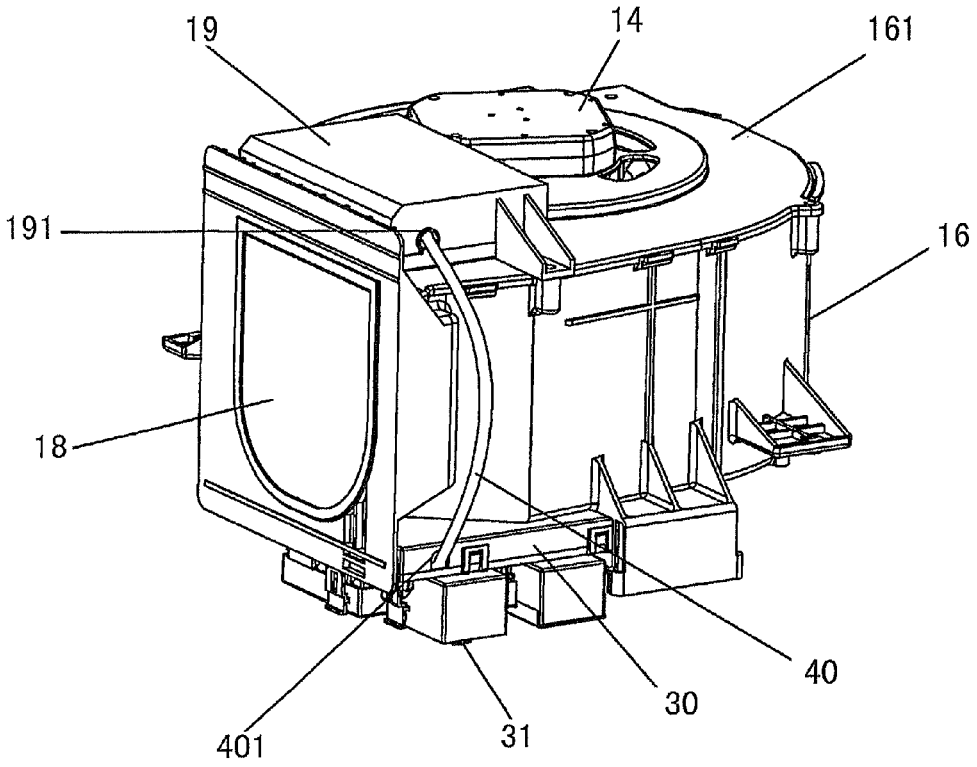
FIG. 1B is a schematic view of a ventilating device according to the first embodiment of the present invention, with a frame being not mounted.
Figure 3:
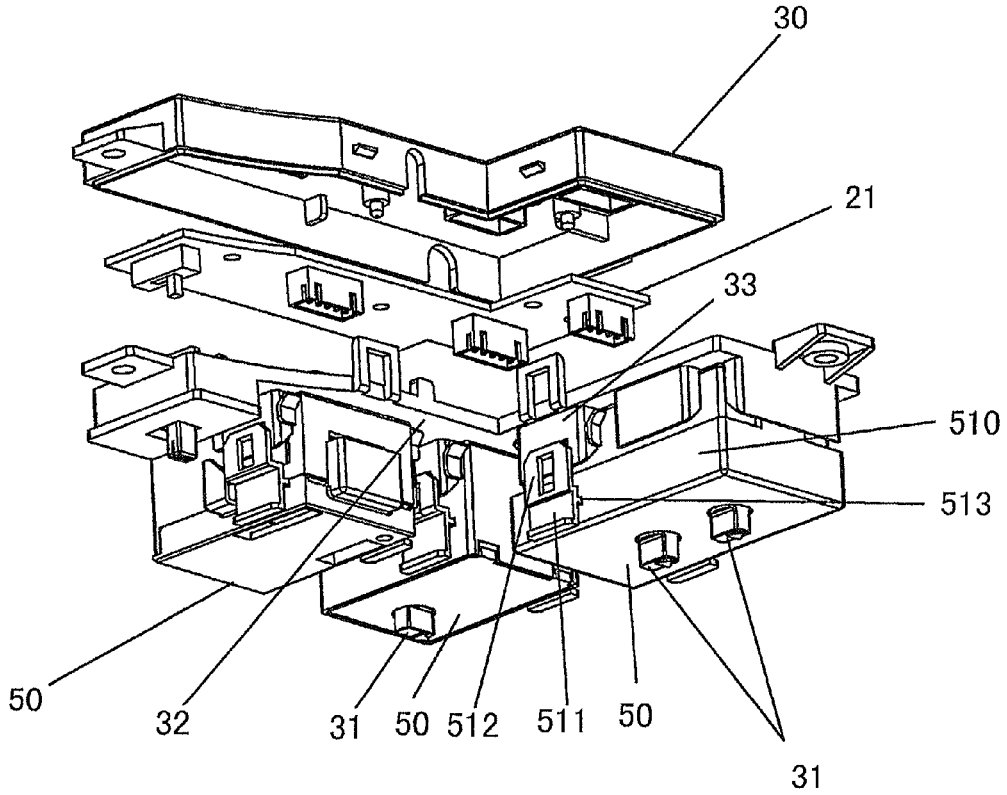
FIG. 3 is a schematic view of a mounting base when disassembled.

FIG. 1A is a schematic view of a ventilating device according to the first embodiment of the present invention; FIG. 1B is a schematic view of the ventilating device according to the first embodiment of the present invention with a frame being not mounted; and, FIG. 3 is a schematic view of a mounting base when disassembled.

As shown in Figures, the present invention provides a ventilating device 10. The ventilating device 10 comprises: a rectangular frame 11 provided with an opening 15 at a bottom thereof, a louver (not shown) covering the bottom of the frame 11, an adapter 12 communicated with outdoor at a side of the frame 11, a helix shell 16 configured to house fan blades 13 and a motor 14 therein, and a circuit board box 19 provided on a top surface of the helix shell 16. An air inlet 17 is provided at a bottom surface of the helix shell 16 and is for communicating with the indoor, and an air outlet 18 is provided at a side surface of the helix shell 16 and is for communicating with the adapter 12. A main circuit board (not shown) is provided within the circuit board box 19 and is for driving the motor 14.

A mounting base 30 is disposed at the bottom, i.e., at the side with the air inlet 17, of the helix shell 16 and is for mounting a plurality of functional units 31 thereon. The mounting base 30 is provided with a base circuit board 21 for collecting signal from the functional units 31. The circuit board box 19 is coupled to the mounting base 30 via a lead wire 40. The mounting base 30 is located at a bottom surface of the helix shell 16. A hole 191, through which the lead wire 40 passes, in the circuit board box 19, and a hole 401, through which the lead wire 40 passes, in the mounting base 30, are arranged in a linear manner in an up-down direction at the side towards the air outlet 18. The plurality of functional units 31 are configured to be freely assembled or disassembled individually to or from the side of the mounting base 30 adjacent to the air inlet 17.

The functional units 31 may include a humidity inductor, a carbon monoxide (CO) inductor, a night-light and a wind quantity adjustor, etc.

Since the functional units 31 are freely assembled/disassembled to/from the mounting base 30, the base circuit board 21 within the mounting base 30 may transmit a signal to the main circuit board via the lead wire 40 connected between the base circuit board 21 and the main circuit board after collecting a signal from the functional units 31. Due to the linear arrangement in the up-down direction of the hole 191, through which the lead wire 40 passes, in the circuit board box 19 and the hole 401, through which the lead wire 40 passes, in the mounting base 30, the lead wire 40 may be configured in a shorter length, thereby resulting in cost reduction of the lead wire 40. Furthermore, as the lead wire 40 is located at the side towards the air outlet 18, it does not interrupt air intake of the air inlet 17 and air discharge of the air outlet 18, preventing poor performance of the device. In addition, as the main circuit board is configured to drive the motor 14 to operate or not to operate according to the received signal, the user only need to mount an added functional unit 31 to be needed directly onto the mounting base 30, or to remove the unneeded functional unit 31 and remount other functional unit(s) onto the mounting base 30, when it is required to add or change the functional unit(s) of the ventilating device, thereby conveniently achieving additions and alternations of the functions of the ventilating device 10.

Also, since the functional unit 31 is connected to the main circuit board via the base circuit board 21, there is no need to provide respective lead wire 40 for each functional unit 31 in order to couple to the main circuit board. From this, installations of the functional units 31 become easy.

Since the mounting base 30 is fixed to a linear portion of the helix shell connecting the air inlet 17 and the air outlet 18, by bolts or a snap-fit structure, etc., the mounting base 30 and the functional units 31 mounted thereon will not interrupt air intake of the air inlet 17.

Return to FIG. 1B, the circuit board box 19 is placed on a top surface 161 of the helix shell 16 close to the air outlet 18, that is, the circuit board box 19 is horizontally placed between the top surface of the frame 11 and the top surface 161 of the helix shell 16.

The lead wire 40 connecting the base circuit board 21 with the main circuit board is led from the hole 401 in the mounting base 30, and then, extends upwardly to the circuit board box 19 on the top surface 161 of the helix shell 16 through the outside of the linear portion of the helix shell 16, i.e., an outside wall of a longitudinal direction with the linear shape in the up-down direction, instead of through the bottom surface 162 of the helix shell 16 at the side facing a user. By this way, the lead wire 40 is invisible when a user views through air gaps in the louver, and thus the ventilating device has a nice appearance with the lead wire 40 in a shorter length.

Figure 2A:
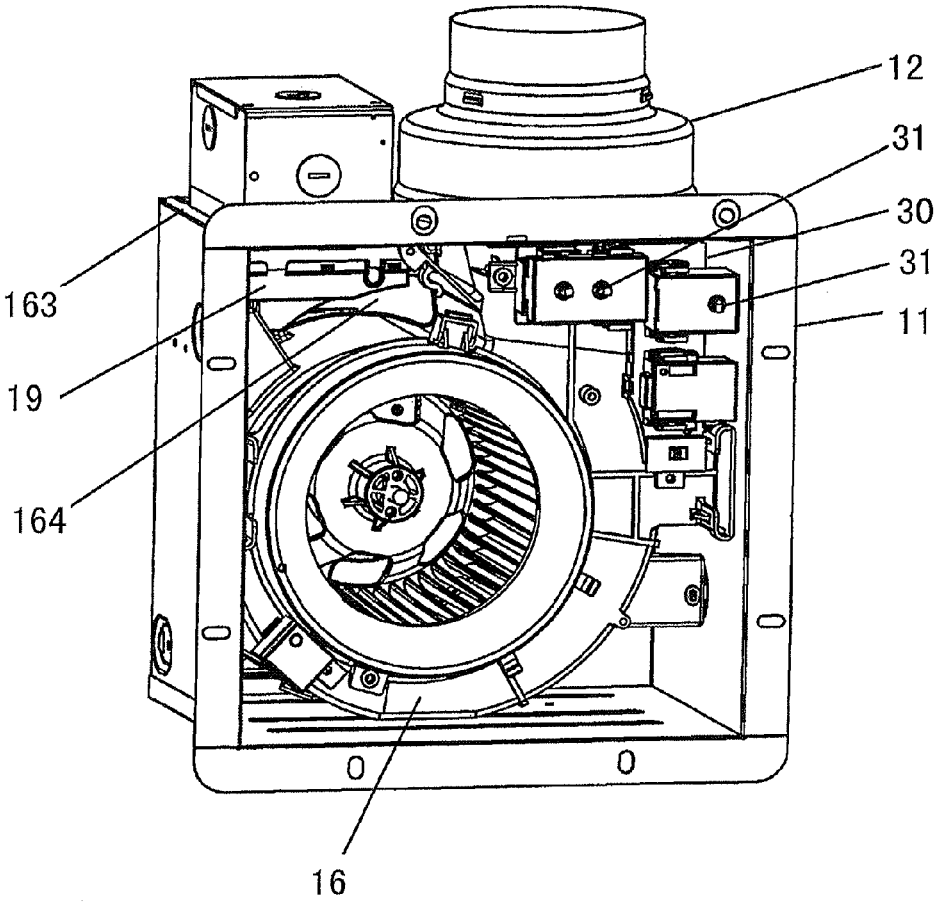
FIG. 2A is a schematic view of a ventilating device according to the second embodiment of the present invention.
Figure 2B:
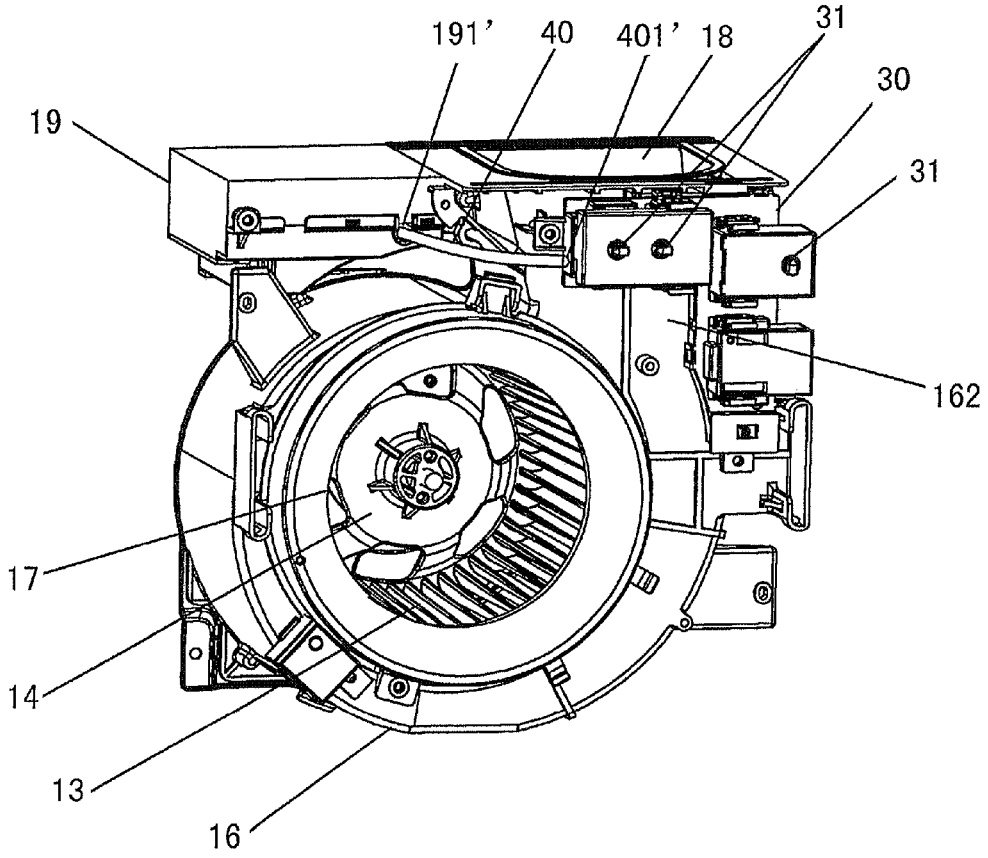
FIG. 2B is a schematic view of a ventilating device according to the second embodiment of the present invention, with a frame being not mounted.

FIG. 2A is a schematic view of the ventilating device according to the second embodiment of the present invention; FIG. 2B is a schematic view of the ventilating device according to the second embodiment of the present invention with the frame disassembled.

As shown in Figures, different from the first embodiment, the circuit board box 19 according to the second embodiment is located on the side 163 of the frame 11 facing the air outlet 18 of the helix shell 16, that is, the circuit board box 19 is vertically placed in a gap 164 that is close to the air outlet 18 and between the side 163 of the frame 11 provided with an adapter 12 and the helix shell 16.

The lead wire 40 connected between the base circuit board 21 and the main circuit board is led from the hole 401' in the mounting base 30, passed through the bottom surface 162 of the side of the helix shell 16 facing the user, and extended upwardly to the circuit board box 19 on the side surface 163 of the frame 11 through the linear portion of the helix shell 16, i.e., an outside wall in a longitudinal direction with the linear shape in the up-down direction. Due to vertical arrangement of the circuit board box 19, compared with the case that the circuit board box 19 is horizontally disposed on the top surface 161 of the helix shell 16, the hole 191' in the circuit board box 19 is located closer the hole 401' in the mounting base 30. By this way, the lead wire may have a shorter length and bring no interruption on air intake of the air inlet in the helix shell.

Figure 4A:
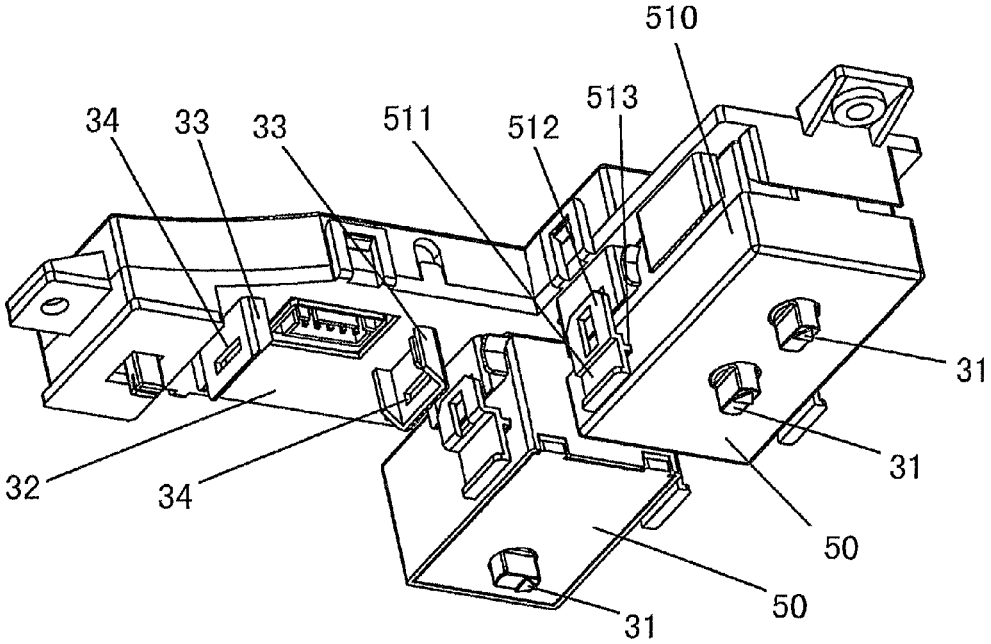
FIG. 4A and 4B are schematic views of installations of a mounting base and a functional unit box, seen from different angle of view.
Figure 4B:
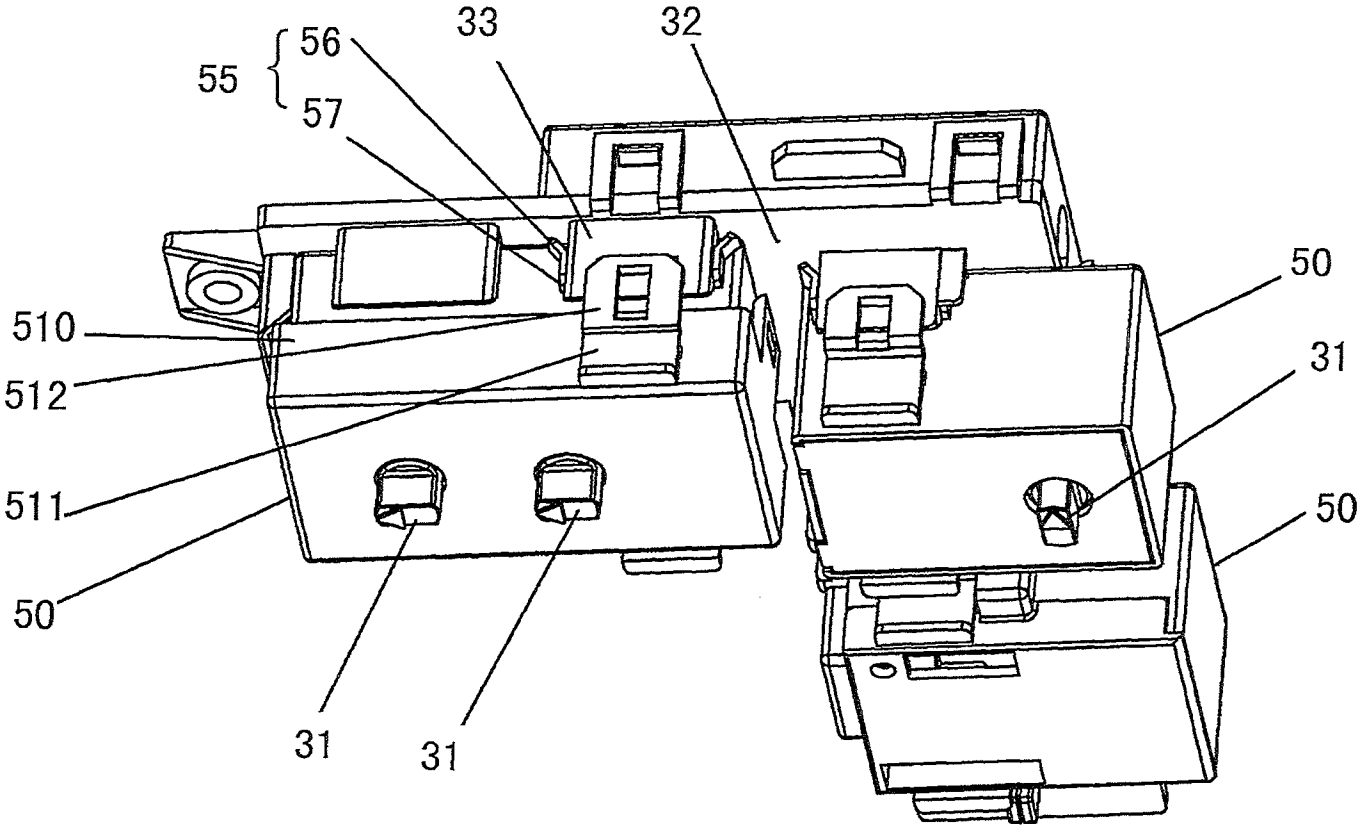
Figure 5:
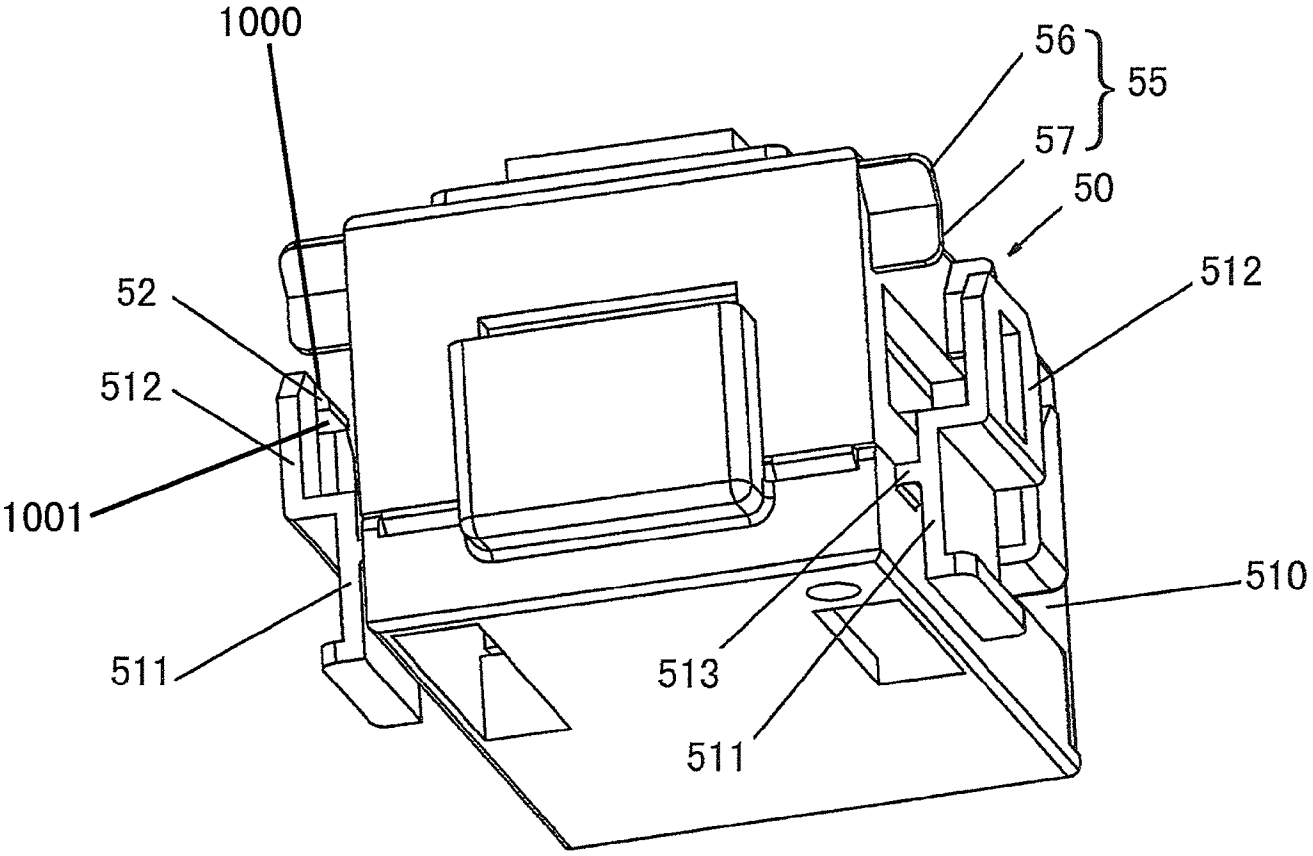
FIG. 5 is a schematic view of a functional unit box.

FIG. 3 is a schematic view of a mounting base when disassembled; FIG. 4A and 4B are schematic views of installations of a mounting base and a functional unit box, seen from different angle of view; FIG. 5 is a schematic view of a functional unit box.

As shown from Figures, the functional units 31 are respectively mounted in the functional unit boxes 50. On an outer wall 510 of each of opposite sides of any of sets functional unit boxes 50, there is an integrally formed projection sheet 513. A first snap-fit sheet 511 is configured to continue from the projection sheet 513 at its lower side and project in a direction opposite to the projection sheet 513 (i.e., away from the projection sheet 513), and a second snap-fit sheet 512 is configured to continue from the projection sheet 513 at its upper side and project in a direction opposite to the projection sheet 513 (i.e., away from the projection sheet 513). At the upper end of the second snap-fit sheet 512 of the projection sheet 513, a hook portion 52 is provided to protrude towards the functional unit box 50. Meanwhile, a pair of downwardly protruding fixing sheets 33 are provided on the bottom surface 32 of the mounting base 30, and each of the fixing sheets 33 is formed with snap-fitted holes 34 to be snap-fitted by the hook portion 52.

After the ventilating device 10 has been mounted on the ceiling and the functional unit box 50 has been mounted on the ventilating device 10, the first snap-fit sheet 511 is located closer to a side towards a user than the second snap-fit sheet 512. Specifically, in order to mount a functional unit box 50, a user only needs to simply push the functional unit box 50 upwardly while pressing the first snap-fit sheet 511 at the lower side of the projection sheet 513 inwardly, i.e., towards the side wall of the functional unit box 50, making the second snap-fit sheet 512 at upper side of the projection sheet 513 move in the opposite direction with relative to movement direction of the first snap-fit sheet 511, i.e., in an opposite direction relative to the direction inwards the side wall, and thus, splay out. When the functional unit box 50 has been pushed upwardly such that the top surface 54 thereof abuts against the bottom surface 32 of the mounting base 30, the user may stop pressing the first snap-fit sheet 511 such that the second snap-fit sheet 512 subsequently is reverted to its initial state and the hook portion 52 on the upper end of the second snap-fit sheet 512 is snap-fitted into the snap-fitted hole 34, thereby achieving installation of the functional unit box 50.

The disassembly of the functional unit box will be proceeded in reverse as the above assembly process, and will be not described in detail.

In addition, the hook portion 52 is formed with a slope guide portion 1000 at upper side, sloping towards the outer wall 510 from up to down, and a connection portion 1001 at lower side, extending towards the snap-fitted hole 34 and configured to be parallel to the top surface 161 of the helix shell 16 (see FIG. 1B). With the above configuration, the functional unit box 50 may be installed by directly pushing it upwardly without pressing the first snap-fit sheet 511. Specifically, when pushing the functional unit box 50 upwardly, the slope guide portion 1000 is in contact with the fixing sheet 33 while the second snap-fit sheet 512 is splaying out away from the side wall of the functional unit box 50 and moving upwardly. When the hook portion 52 is snap-fitted into the snap-fitted hole 34, the connection portion 1001 is in contact with and engaged to the snap-fitted hole 34, thereby completing installation of the functional unit box 50.

It can be seen from the above description that the functional unit box 50 has advantages of convenient additions and/or alterations of function(s) for the ventilating device as required, easy installation, convenient wiring and low cost.

Return to FIG. 4B, the functional unit box 50 is provided with guide ribs 55 at both sides above the second snap-fit sheet 512, and each of the guide ribs 55 includes a sloped portion 56 widening outwardly in an upward direction and a vertical portion 57 arranged along an end side of the fixing sheet 33 in a downward direction.

When a functional unit box 50 is pushed upwardly by a user to bring it to be in contact with the mounting base 30 so as to install the functional unit box 50 onto the mounting base 30, the fixing sheet 33 is contacted with and is guided by the sloped portions 56 of the guide ribs 55 and the vertical portions 57 are attached to both sides 332 of the fixing sheet 33, from its lower side 331, of the mounting base 30, while installation position of the functional unit box 50 is defined by the fixing sheet 33. Continuously pushing the functional unit box 50 towards the mounting base 30, the hook portion 52 of the second snap-fit sheet 513 will be simply and precisely aligned with the snap-fit hole 34 in the fixing sheet 33, thereby achieving a more convenient installation of the functional unit box 50.

Although several exemplary embodiments have been shown and described, it would be appreciated by those skilled in the art that various changes or modifications may be made in these embodiments without departing from the principles and spirit of the present invention, the scope of which is defined in the claims and their equivalents.

The invention claimed is:

1. A ventilating device, comprising:

a rectangular frame provided with an opening at a bottom thereof, a louver covering the bottom of the frame, an adapter communicating with an outdoor space at one side of the frame, a helix shell configured to house fan blades and a motor therein, and a circuit board box disposed in the frame; the helix shell being provided with an air inlet for communicating with an indoor space and an air outlet for communicating with the adapter, and the circuit board box having a main circuit board for driving the motor therein, the ventilating device being characterized in that, a mounting base for installation of a plurality of functional units thereon is disposed at a lower side of the helix shell, wherein, the mounting base is provided with a base circuit board for collecting a signal from the functional units, the circuit board box is coupled to the mounting base by a lead wire, and, the mounting base is located at a bottom surface of the helix shell, and wherein, a hole, through which the lead wire passes, in the circuit board box and a hole, through which the lead wire passes, in the mounting base are arranged in a linear manner in an up-down direction at sides of the circuit board box and the mounting base towards the air outlet, and the plurality of functional units are configured to be freely assembled or disassembled individually to or from the mounting base, wherein, the circuit board box is disposed on a top surface of the helix shell close to the air outlet, and horizontally placed between the top surface of the frame and the top surface of the helix shell, wherein, the functional units are respectively mounted in functional unit boxes, and, on an outer wall of each of opposite sides of any of sets functional unit boxes, an integrally formed projection sheet, of which a first snap-fit sheet is configured to continue from the projection sheet at a lower side thereof and project in a downward direction, and a second snap-fit sheet is configured to continue from the projection sheet at an upper side thereof and project in an upward direction, are provided, wherein, at the upper end of the second snap-fit sheet of the projection sheet, a hook portion is provided to protrude towards the functional unit box, a pair of downwardly protruding fixing portions is provided on the bottom surface of the mounting base, and, each fixing sheet is formed with snap-fitted holes to be snap-fitted by the hook portion.

2. The ventilating device according to claim 1, wherein, the functional unit box is provided with guide ribs at both sides above the second snap-fit sheet, and each of the guide ribs includes a sloped portion widening outwardly in an upward direction and a vertical portion arranged along an end side of the fixing sheet in a downward direction.

3. The ventilating device according to claim 1, wherein, the hook portion is formed with a slope guide portion at an upper side thereof, sloping towards the outer wall from up to down, and a connection portion at a lower side thereof, extending towards the snap-fitted hole and configured to be parallel to the top surface of the helix shell.

* * * * *